US007617646B2

(12) United States Patent
Losse

(10) Patent No.: US 7,617,646 B2
(45) Date of Patent: Nov. 17, 2009

(54) SUPPORT PANEL

(76) Inventor: Ronald B. Losse, 2286-3 Wednesday St., Tallahassee, FL (US) 32312

( * ) Notice: Subject to any disclaimer, the term of this patent is extended or adjusted under 35 U.S.C. 154(b) by 1065 days.

(21) Appl. No.: 10/866,933

(22) Filed: Jun. 14, 2004

(65) Prior Publication Data

US 2005/0284063 A1 Dec. 29, 2005

(51) Int. Cl.
*E04F 13/09* (2006.01)
*E04B 2/00* (2006.01)
*E04B 1/02* (2006.01)

(52) U.S. Cl. ..... 52/385; 52/387; 52/434; 52/562; 52/506.08

(58) Field of Classification Search ..... 52/384–389, 52/434, 506.08, 774
See application file for complete search history.

(56) References Cited

U.S. PATENT DOCUMENTS

| | | | | | |
|---|---|---|---|---|---|
| 1,850,961 | A | | 3/1932 | Mortenson | |
| 1,861,359 | A | | 5/1932 | Pyron | |
| 1,946,690 | A | | 2/1934 | Haines | 72/19 |
| 2,043,706 | A | | 6/1936 | Myers | 72/20 |
| 3,533,206 | A | * | 10/1970 | Passeno, Jr | 52/387 |
| 4,662,140 | A | | 5/1987 | Porter et al. | 52/385 |
| 4,809,470 | A | | 3/1989 | Bauer et al. | 52/97 |
| 4,856,246 | A | * | 8/1989 | Shimasaki | 52/386 |
| 4,883,503 | A | | 11/1989 | Fish | 52/220 |
| 4,947,600 | A | | 8/1990 | Porter | 52/235 |
| 4,953,337 | A | | 9/1990 | Mills | 52/385 |
| 5,125,204 | A | | 6/1992 | Porter | 52/393 |
| 5,228,937 | A | | 7/1993 | Passeno | 156/299 |
| 5,268,137 | A | | 12/1993 | Scott et al. | 264/225 |
| 5,311,714 | A | | 5/1994 | Passeno | 52/314 |
| 5,499,476 | A | | 3/1996 | Adams et al. | 52/220.1 |
| RE35,369 | E | | 11/1996 | Ducroux et al. | 52/126.6 |
| 5,673,522 | A | | 10/1997 | Schilham | 52/263 |
| 5,675,950 | A | | 10/1997 | Schilham | 52/263 |
| 5,713,168 | A | | 2/1998 | Schilham | 52/220.5 |
| 5,860,261 | A | | 1/1999 | LeBlanc | 52/385 |
| 6,098,363 | A | | 8/2000 | Yaguchi | 52/385 |
| 6,516,578 | B1 | | 2/2003 | Hunsaker | 52/387 |
| 6,641,685 | B2 | | 11/2003 | Guddal | 156/71 |

* cited by examiner

*Primary Examiner*—Richard E Chilcot, Jr.
*Assistant Examiner*—Elizabeth A Plummer
(74) *Attorney, Agent, or Firm*—Price, Heneveld, Cooper, DeWitt & Litton, LLP

(57) ABSTRACT

A support panel comprising a plate including a face, at least one row of support tabs and at least one row of L-shaped fingers. The at least one row of L-shaped fingers are located above at least one of the at least one row of support tabs. The L-shaped fingers include a first portion and a second portion defining the L-shape of the L-shaped fingers. A tile can be placed on at least one of the tabs and maintained in position by the second portion of at least one of the L-shaped fingers. Alternatively, the plate could include at least one row of upwardly and outwardly angled tongues for insertion into at least one angled slot in a rear face of a tile to maintain the tiles in position adjacent a front of the plate.

26 Claims, 5 Drawing Sheets

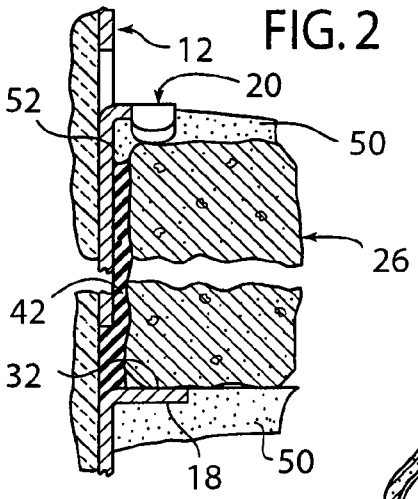
FIG. 2
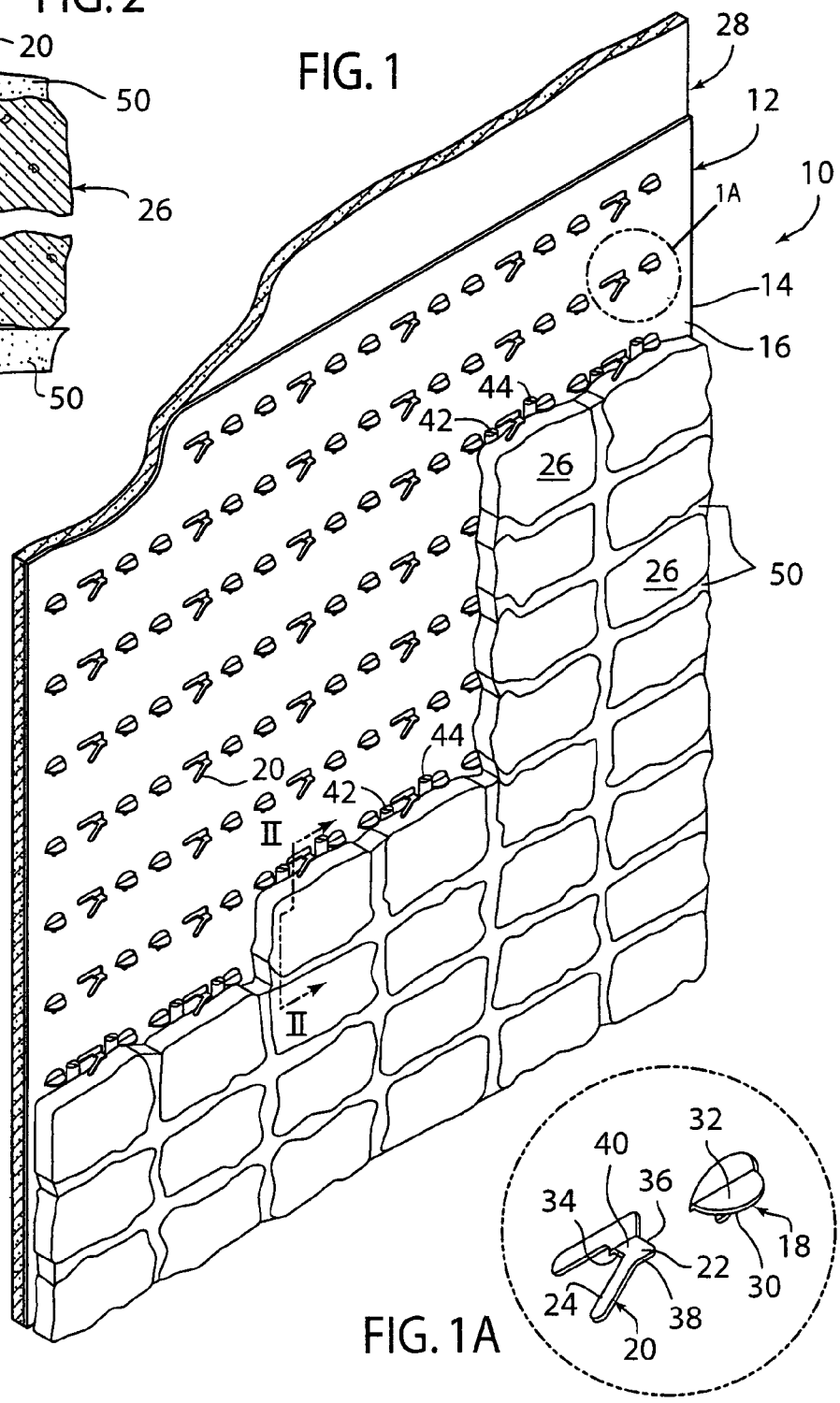
FIG. 1
FIG. 1A

SUPPORT PANEL

BACKGROUND OF THE INVENTION

The present invention relates generally to building materials and structures and is particularly directed to a support panel for supporting tiles.

Face brick structures are used in building construction to improve appearance and enhance durability. Prior art tile structures typically include a sheet metal tile support structure attached to a wall to be covered by the face tiles. An example of this approach is disclosed and claimed in U.S. Pat. No. 4,662,140 to Porter et al. The tile support structure of U.S. Pat. No. 4,662,140 includes tabs configured to be placed under tiles in a row to assist in aligning the tiles. However, the tabs do not always properly secure tiles or stones having irregular edges in a pleasing aesthetic manner.

Accordingly, an apparatus is desired having the aforementioned advantages and solving and/or making improvements on the aforementioned disadvantages.

SUMMARY OF THE PRESENT INVENTION

An aspect of the present invention is to provide a support panel comprising a plate including a face, at least one row of support tabs and at least one row of L-shaped fingers. The at least one row of L-shaped fingers is located above at least one of the at least one row of support tabs. The L-shaped fingers include a first portion and a second portion defining the L-shape of the L-shaped fingers. The first portion of the L-shaped fingers extend outwardly from the face of the plate and have a first side, a second side and an end opposite the face. The second portion of the L-shaped fingers extend laterally from the first side of the first portion of the L-shaped fingers. A tile can be placed on at least one of the tabs and maintained in position by the second portion of at least one of the L-shaped fingers.

Another aspect of the present invention is to provide a brick support panel assembly comprising a plurality of bricks and a plate including at least one row of support tabs and at least one row of L-shaped fingers. The at least one row of L-shaped fingers are located above the at least one row of support tabs. The L-shaped fingers include a first portion and a second portion defining the L-shape of the L-shaped fingers. The bricks are positioned on the tabs and the second portions of the L-shaped fingers abut a top of the bricks to maintain the bricks in position adjacent a front of the plate.

Yet another aspect of the present invention is to provide a support panel comprising a plate including a face, at least one row of planar support tabs and at least one row of L-shaped fingers. The at least one row of L-shaped fingers are located above at least one of the at least one row of support tabs. The L-shaped fingers include a first portion and a second portion defining the L-shape of the L-shaped fingers. A tile can be placed on at least one of the tabs and maintained in position by the second portion of at least one of the L-shaped fingers.

A further aspect of the present invention is to provide a method of constructing a wall comprising providing a plurality of tiles and providing a plate including at least one row of support tabs and at least one row of L-shaped fingers. The at least one row of L-shaped fingers are located above the at least one row of support tabs. The L-shaped fingers include a first portion and a second portion defining the L-shape of the L-shaped fingers. The method also includes placing the tiles on the support tabs and bending the second portion of the L-shaped fingers to abut against a top of the tiles.

Yet another aspect of the present invention is to provide a tile support panel assembly comprising a plurality of tiles, with each tile having at least one angled slot in a rear face thereof. The tile support panel assembly also includes a plate including at least one row of upwardly and outwardly angled tongues. The angled tongues are inserted into the slots on the rear face of the tiles to maintain the tiles in position adjacent a front of the plate.

Another aspect of the present invention is to provide a method of constructing a wall comprising providing a plurality of tiles, providing a plate including at least one finger extending from a face of the plate, positioning the tiles adjacent the face of the plate, positioning a cementitious material between the tiles and adjacent the face of the plate, and locating the cementitious material between the face of the plate and a portion of the at least one finger in a direction perpendicular to the face of the plate.

Yet another aspect of the present invention is to provide a wall comprising a plurality of tiles, a plate including at least one finger extending from a face of the plate, with the tiles adjacent the face of the plate, and a cementitious material between the tiles and adjacent the face of the plate, wherein the cementitious material is located between the face of the plate and a portion of the at least one finger in a direction perpendicular to the face of the plate.

These and other aspects, objects, and features of the present invention will be understood and appreciated by those skilled in the art upon studying the following specification, claims, and appended drawings.

BRIEF DESCRIPTION OF DRAWINGS

FIG. 1 is a perspective partial view of a wall employing the support panel of the present invention.

FIG. 1A is an enlarged view of the support panel of the present invention taken from area 1A of FIG. 1.

FIG. 2 is a partial side view of the support panel and bricks of the present invention.

DETAILED DESCRIPTION OF PREFERRED EMBODIMENTS

Figure 3:
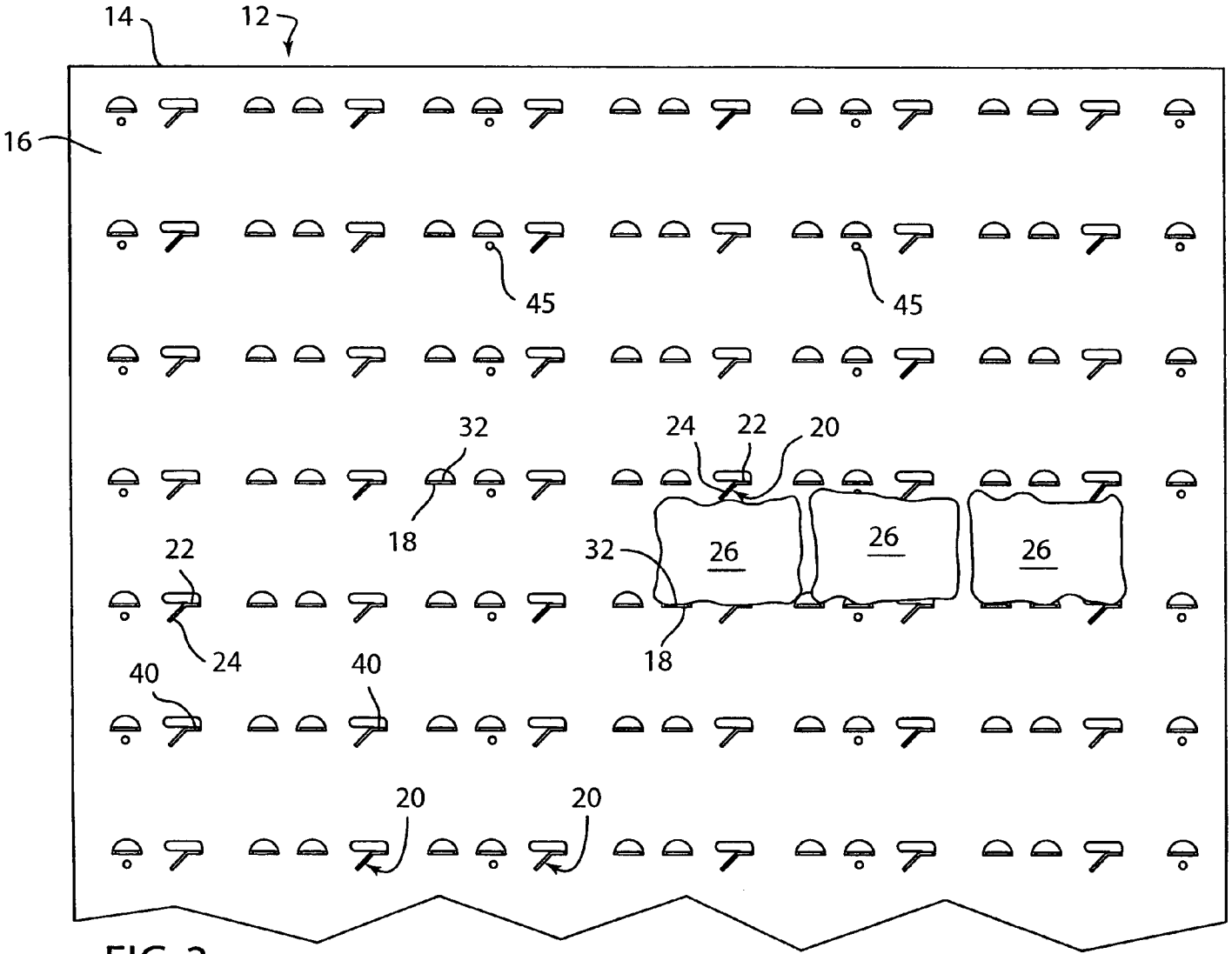
FIG. 3 is a partial front view of the support panel and bricks of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a wall embodying the present invention. In the illustrated example, the wall 10 includes a support panel 12 comprising a plate 14 having a face 16, at least one row of support tabs 18 and at least one row of L-shaped fingers 20. The at least one row of L-shaped fingers 20 are located above at least one of the at least one row of support tabs 18. The L-shaped fingers 20 include a first portion 22 and a second portion 24 defining the L-shape of the L-shaped fingers 20. A tile 26 can be placed on at least one of the support tabs 18 and maintained in position by the second portion 24 of at least one of the L-shaped fingers 20. As used herein, the term "tile" includes any slab of hard material, including bricks, stones and ceramic tiles.

The illustrated support panel 12 and tiles 26 (FIGS. 1-3) are connected to support structure 28 to define the wall 10. The illustrated support panel 12 includes the plate 14 comprising the face 16, a plurality of rows of support tabs 18 and a plurality of rows of L-shaped fingers 20. The plate 14 is preferably made of sheet metal and the support tabs 18 and the L-shaped fingers 20 are preferably stamped into the plate 14 and are punched-out as illustrated in FIGS. 1-3. In the illustrated example, each row of support tabs 18 is parallel with one row of L-shaped fingers 20. Furthermore, each row of support tabs 18 and L-shaped fingers 20 includes a pair of adjacent support tabs 18 separated by one L-shaped finger 20. However, it is contemplated that each row of support tabs 18 does not have to be aligned with a row of L-shaped fingers 20. Furthermore, each row of support tabs 18 and L-shaped fingers 20 could have any number of support tabs 18 separated by any number of L-shaped fingers 20. Moreover, a top row of the support panel 12 does not have to include a row of support tabs 18 as no tiles have to be supported above a top edge of the support panel 12. Likewise, a bottom row of the support panel 12 does not have to include a row of L-shaped fingers 20 as no tiles have to be supported below a bottom edge of the support panel 12. However, it is contemplated that tiles 26 could be supported above the top edge or the bottom edge of the support panel 12.

In the illustrated example, the support tabs 18 are used to support tiles 26 placed adjacent the face 16 of the plate 14. The illustrated support tabs 18 have a semi-circular periphery 30, although it is contemplated that the support tabs 18 could have any geometric shape. The support tabs 18 are preferably planar and top surfaces 32 of all punched-out support tabs 18 in a particular row are preferably parallel. As discussed in more detail below, tiles 26 are placed on the top surfaces 32 of the support tabs 18 to maintain the tiles 26 in position as the wall 10 is constructed.

The illustrated L-shaped fingers 20 assist in maintaining the tiles 26 on the support tabs 18 as the wall 10 is constructed. The first portion 22 of the L-shaped fingers 20 extend from the face 16 and include a first side 34, a second side 36 and an end 38 opposite the face 16. The second portion 24 of the L-shaped fingers 20 extend from the first side 34 of the first portion 22 of the L-shaped fingers 20. Top surfaces 40 of all punched-out first portions 22 of the L-shaped fingers 20 in a particular row are preferably parallel. Furthermore, the second portion 24 of the L-shaped finger 20 is preferably longer than the first portion 22 in a direction parallel to the face 16 of the plate 14 to allow easier bending of the second portion 24. Therefore, the second portion 24 preferably has a width in a direction parallel to the face 16 and the first portion 22 has a length in a direction perpendicular to the face 16, with the width of the second portion 24 being longer than the length of the first portion 22. The second portion 24 of the L-shaped fingers 20 bend downward to maintain the tiles 26 on the support tabs 18.

In the illustrated example, the L-shaped fingers 20 and the support tabs 18 of the plate 14 assist in maintaining the tiles 26 in position adjacent the face 16 of the plate 14. In the illustrated example, the support panel 12 is connected to the support structure 28 to construct the wall 10. The support structure 28 can comprise any interior or exterior support. Fasteners (not shown) are preferably inserted into openings 45 in the plate 14 to connect the plate 14 to the support structure 28. However, it is contemplated that the plate 14 could be connected to the support structure 28 in any manner. For example, the support panel 12 could include a top portion that extends rearward for connection to a part of the support structure 28 such that the remainder of the plate 14 is spaced from the support structure 28 (or includes insulation between the plate 14 and the support structure 28). Furthermore, although the support panel 12 is illustrated as being connected to vertical and planar support structure 28, it is contemplated that the support panel 12 could be connected to any support structure in any orientation (e.g., walls, floors and roofs) and to a curved support structure.

The illustrated wall 10 is preferably constructed by first placing a pair of generally parallel, elongated adhesive strips 42, 44 on the face 16 of the plate 14 behind each tile 26. The adhesive strips 42, 44 are preferably comprised of a viscous adhesive material such as epoxy cement. Thereafter, the tiles 26 are placed on the support tabs 18 and pushed into contact with the pair of adhesive strips 42, 44, preferably starting from a bottom of the support panel 12. In the illustrated example, the tiles 26 are irregularly shaped bricks. However, it is contemplated that the tiles 26 could comprise any thin, flat or convex slab of hard material, such as baked clay or plastic, having any geometric configuration. Preferably, each tile 26 is supported by a pair of adjacent support tabs 18, although any number of support tabs 18 could support each tile 26. After one of the tiles 26 has been positioned on the support tabs 18, the second portion 24 of the L-shaped finger 20 located above the particular tile 26 is bent downward to contact the top of the tile 26, thereby maintaining the tile 26 in position.

In the illustrated example, the support panel 12 can support tiles 26 having any shape and in any orientation. Since the second portion 24 of the L-shaped fingers 20 abuts against the top of the tiles 26 to maintain the tiles 26 in position on the support panel 12, the tiles 26 will not slide off of the support tabs 18. While the tiles 26 are illustrated as being substantially horizontally orientated, the tiles 26 could have a substantially vertical orientation. If the tiles 26 have a height larger than the distance between a lower row of support tabs 18 upon which the tiles 26 rest and one or more rows of L-shaped fingers 20 and/or support tabs 18 located directly above the lower row of support tabs 18 upon which the tiles 26 rest, the L-shaped fingers 20 in the higher row(s) (along with any aligned support tabs 18) which would be located behind the tiles 26 could be removed, thereby allowing the tiles 26 to be held in position by a row of L-shaped fingers 20 located above tiles 26 once they are positioned on the support tabs 18. The L-shaped fingers 20 (and any aligned support tabs 18) can be removed by separating the L-shaped fingers 20 (and any aligned support tabs 18) from the plate 14 or by hammering each L-shaped finger 20 (and any aligned support tab 18) back into the plate 14, thereby providing the support panel 12 with a smooth surface behind the tiles 26. It is contemplated that the L-shaped fingers 20 (and any aligned support tabs 18) can be removed in other manners.

Once the illustrated tiles 26 are located on the support tabs 18 and maintained in position with the second portion 24 of the L-shaped fingers 20, the tiles 26 are fixed into position to form the wall 10. Preferably, after each tile 26 is supported by the support tabs 18, positioned in contact with the adhesive strips 42, 44, and maintained in position with the L-shaped fingers 20, a cementitious material 50, such as grout, mortar or an acrylic modified mortar, is inserted between immediately adjacent tiles 26. In a preferred embodiment, in order to provide coupling between the plate 14 and the cementitious material 50 positioned thereon, an outer adhesive layer 52 is deposited upon the face 16 of the plate 14 prior to application of the cementitious material 50 in inter-tile spaces thereon. In a preferred embodiment, the cementitious material 50 is comprised of an acrylic mortar for increased strength of bonding with the support panel 12 as well as to immediately adjacent tiles 26 and for waterproofing of the wall 10. However, it is contemplated that the wall 10 could be constructed without use of the outer adhesive layer 52.

Figure 4:
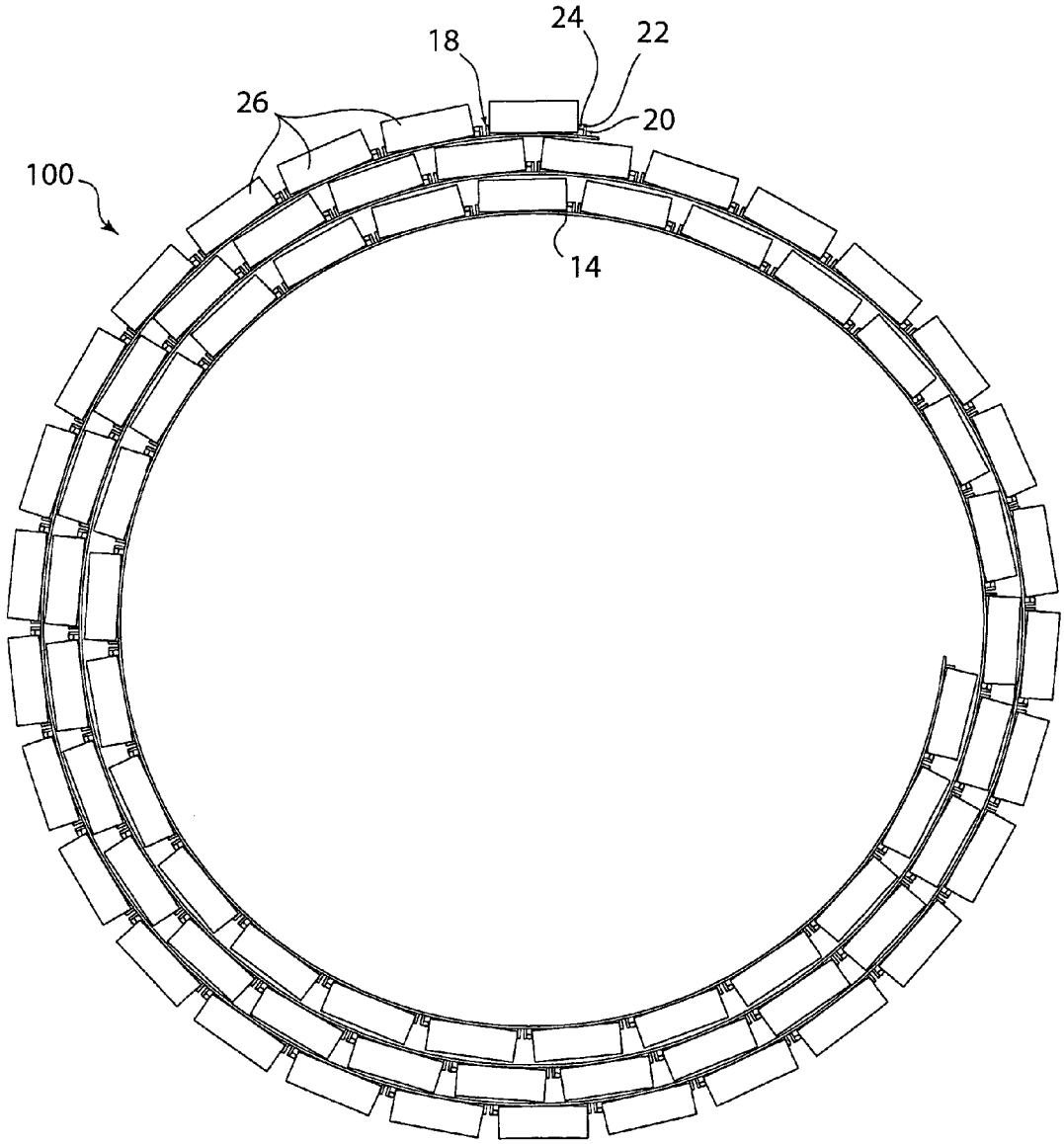
FIG. 4 is a side view of the support panel and bricks of the present invention in a roll.

FIG. 4 illustrates a method of transporting the support panel 12 before the support panel 12 is connected to the support structure 28. The tiles 26 can be connected to the support panel 12 as described above by placing the tiles 26 on the support tabs 18, adhering the tiles 26 to the pair of adhesive strips 42, 44, and bending the second portion 24 of the L-shaped finger 20 to abut the top of the tile 26. Thereafter, the plate 14 of the support panel 12 can be rolled up as illustrated in FIG. 4 to make a portable tile and support panel roll 100 that can easily be transported to the location of the support structure 28. After the portable tile and support panel roll 100 is transported to the location of the support structure 28, the support panel 12 is unrolled and connected to the support structure 28. Thereafter, the cementitious material 50 is inserted between immediately adjacent tiles 26 to complete the wall 10.

Figure 5:
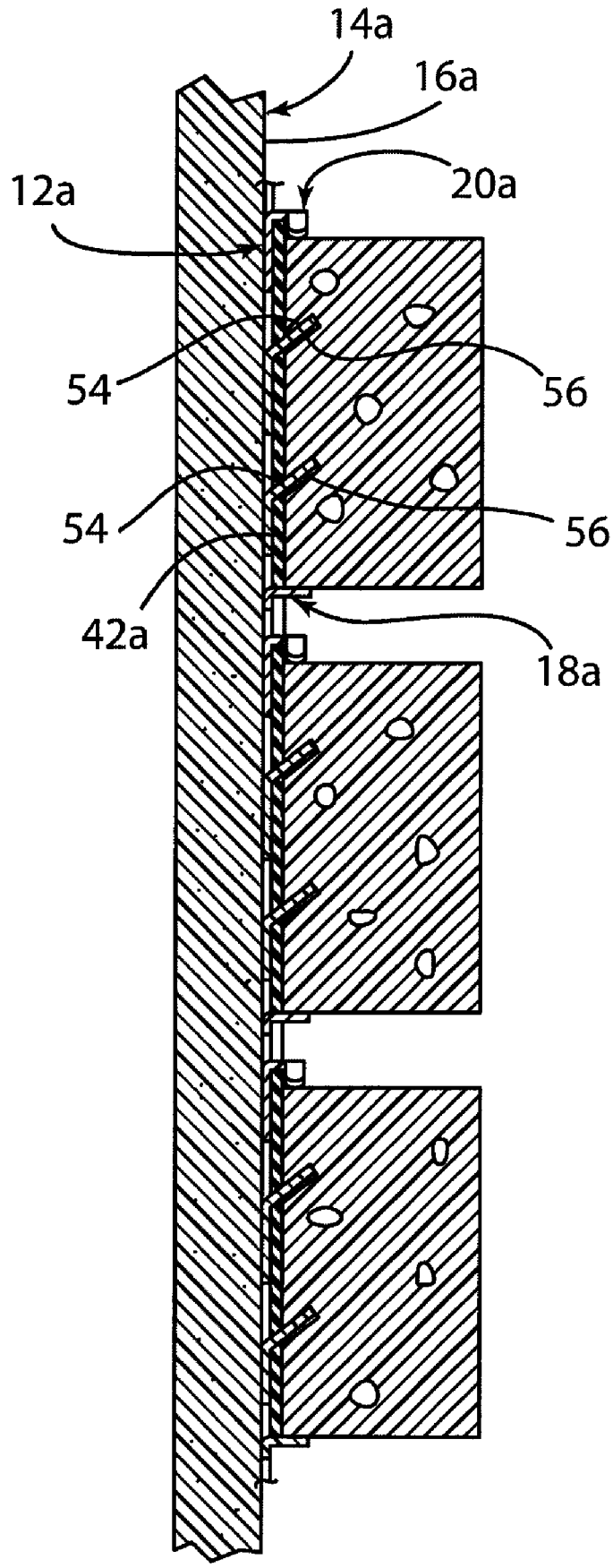
FIG. 5 is a side view of a second embodiment of the support panel and bricks of the present invention.

The reference numeral 12*a* (FIG. 5) generally designates another embodiment of the present invention, having a second embodiment for the support panel. Since the second embodiment of the support panel 12*a* is similar to the previously described support panel 12, similar parts appearing in FIGS. 1-4 and FIG. 5, respectively, are represented by the same, corresponding reference number, except for the suffix "a" in the numerals of the latter. The second embodiment of the support panel 12*a* includes a plurality of angled tongues 54 extending upwardly and outwardly from the face 16*a* of the plate 14*a*. The angled tongues 54 are configured to be inserted into slots 56 in the rear of the tiles 26*a* to maintain the tiles 26*a* in position on the support panel 12*a*. In the illustrated example, each tile 26 is slid downwardly onto the angled tongues 54, thereby inserting the angled tongues 54 into the slots 56. Preferably, each tile 26 includes two vertically aligned slots 56 for accepting two vertically aligned angled tongues 54 therein. Furthermore, the angled tongues 54 are preferably located between the pair of adhesive strips 42*a*, 44*a* on the face 16*a* of the plate 14*a*. The slots 56 can be formed when the tile 26*a* is formed, can be drilled or cut into the rear face of the tiles 26*a* after they are formed or can be created in other manners. While the illustrated example of the second embodiment of the support panel 12*a* includes the support tabs 18*a* and the L-shaped fingers 20*a* in addition to the angled tongues 54 for maintaining the tiles 26*a* in position, it is contemplated that the second embodiment of the support panel 12*a* could be employed without either or both of the support tabs 18*a* and the L-shaped fingers 20*a*.

Figure 6:
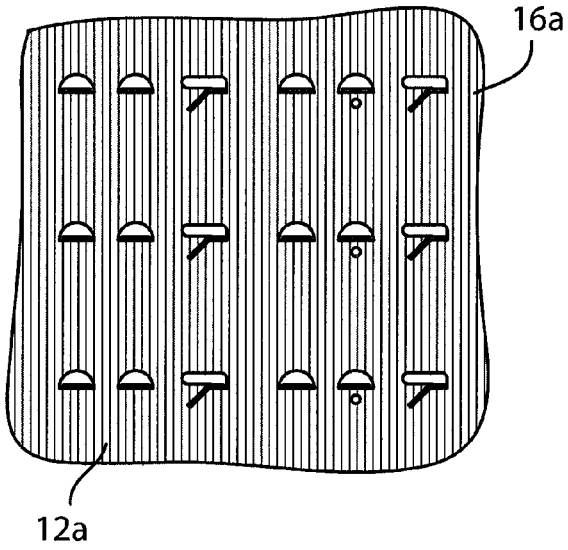
FIG. 6 is a partial side view of a third embodiment of the support panel of the present invention.
Figure 7:
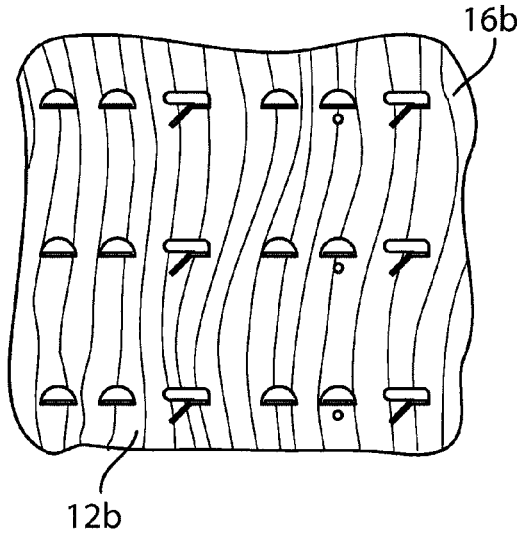
FIG. 7 is a partial side view of a fourth embodiment of the support panel of the present invention.
Figure 8:
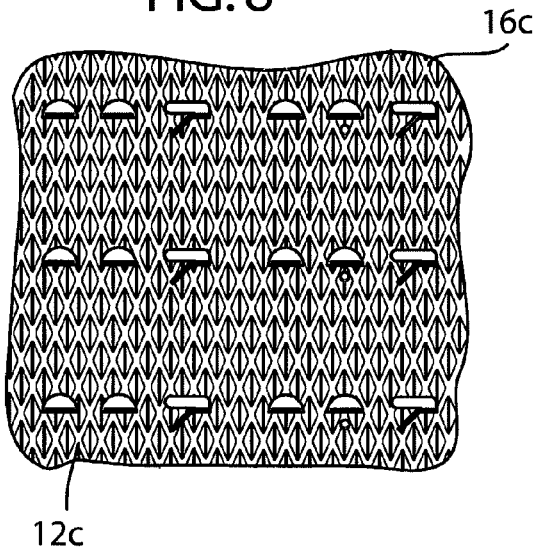
FIG. 8 is a partial side view of a fifth embodiment of the support panel of the present invention.
Figure 9:
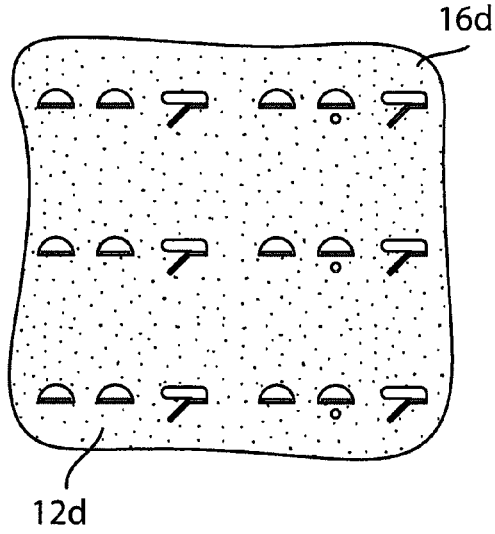
FIG. 9 is a partial side view of a sixth embodiment of the support panel of the present invention.

FIGS. 6-9 illustrate further embodiment of the support panel, with the support panels having an embossed face. FIG. 6 illustrates a third embodiment of the support panel 12*a* having a face 16*a* with vertical embossments. FIG. 7 illustrates a fourth embodiment of the support panel 12*b* having a face 16*b* with a wood grain embossed face. FIG. 8 illustrates a fifth embodiment of the support panel having a face 16*c* with diamond shaped embossments. FIG. 9 illustrates a sixth embodiment of the support panel having a face 16*d* with a stucco embossment. All of the embossments of FIGS. 6-9 assist in moving moisture down the faces 16*a*-16*d* of the support panels 12*a*-12*d*.

In the illustrated invention, the support tabs 18 and the L-shaped fingers 20 will maintain tiles 26 of any in position during construction of the wall 10, thereby easing construction of the wall 10. Furthermore, since the support tabs 18 and the L-shaped fingers 20 can be punched out of the support panel 12, moisture between the tiles 26 and the face 16 of the support panel 12 can run down the face 16 of the support panel 12 and escape through the openings formed during punching out the support tabs 18 and the L-shaped fingers 20 and down the back of the support panel 12. The embossments of the support panels 12*a*-12*d* of FIGS. 6-9 assist in moving the moisture down the face 16*a*-16*d* of the support panels 12*a*-12*d* and out through the openings. Furthermore, the vertical adhesive strips 42, 44 allow the moisture to run down the face 16. Moreover, it is contemplated that the wall 10 could include a water infiltration barrier located behind the support panel 12 to prevent moisture from infiltrating the wall 10. Accordingly, the support panel 12 of the present invention allows moisture to escape the wall 10.

The illustrated support panel 12 also assists in maintaining the cementitious material 50 against the support panel 12 to thereby maintain the tiles 26 against the face 16 of the support panel 12. Since the L-shaped fingers 20 include a portion extending laterally from first portion 22 thereof, the L-shaped fingers 20 are able to capture the cementitious material 50 between a portion of the L-shaped fingers 20 and the face 16 of the support panel 12. Therefore, the cementitious material 50 is locked in position against the face 16 of the support panel 12. Consequently, the tiles 26 connected to the cementitious material 50 can not move. While the shape of the L-shaped fingers 20 lock the cementitious material 50 is position against the face 16 of the support panel 12, it is contemplated that any shaped finger would lock the cementitious material 50 against the face 16 of the support panel 12 as long as a portion of the cementitious material 50 is located between the face 16 of the support panel 12 and any portion of the finger. For example, the cementitious material 50 would be locked in position if it extended through an opening in the finger or if the finger included a portion extending laterally from a base of the finger that extends from the support panel 12 (e.g., the second 24 of the L-shaped fingers 20).

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. A support panel comprising:

a plate including a face, at least one row of support tabs and at least one row of L-shaped fingers;

the at least one row of L-shaped fingers being located above at least one of the at least one row of support tabs;

the L-shaped fingers including a first portion and a second portion defining the L-shape of the L-shaped fingers;

the first portion of the L-shaped fingers extending outwardly from the face of the plate and having a first side, a second side, a top side, a bottom side and an end opposite the face; and the second portion of the L-shaped fingers extending laterally from the first side of the first portion of the L-shaped fingers;

wherein a tile can be placed on at least one of the tabs and maintained in position by the second portion of at least one of the L-shaped fingers; and wherein the second portion is longer than the first portion in a horizontal direction parallel to the face.

2. The support panel of claim 1, wherein:

the at least one row of support tabs comprises a first row of support tabs and a second row of support tabs;

the at least one row of L-shaped fingers comprises a first row of L-shaped fingers and a second row of L-shaped fingers;

the first row of L-shaped fingers is located above the first row of support tabs; and the second row of L-shaped fingers is located above the second row of support tabs.

3. The support panel of claim 2, wherein:

the first row of support tabs and the second row of L-shaped fingers are aligned.

4. The support panel of claim 1, wherein:

the support tabs are only planar.

5. The support panel of claim 1, wherein:

the plate includes a plurality of openings therethrough for accepting fasteners for connecting the plate to a support surface.

6. The support panel of claim 1, wherein:

the support tabs have a semi-circular periphery.

7. The support panel of claim 1, wherein:

the plate is comprised of metal.

8. The support panel of claim 1, wherein:

the face of the plate comprises an embossment.

9. The support panel of claim 8, wherein:

the embossment comprises a plurality of vertical lines.

10. The support panel of claim 8, wherein:

the embossment comprises a plurality of diamonds.

11. The support panel of claim 8, wherein:

the embossment comprises a wood grain.

12. The support panel of claim 8, wherein:

the embossment comprises stucco.

13. A support panel comprising:

a plate including a face, at least one row of support tabs and at least one row of L-shaped fingers;

the at least one row of L-shaped fingers being located above at least one of the at least one row of support tabs;

the L-shaped fingers including a first portion and a second portion defining the L-shape of the L-shaped fingers;

the first portion of the L-shaped fingers extending outwardly from the face of the plate and having a first side, a second side, a top side, a bottom side and an end opposite the face; and the second portion of the L-shaped fingers extending laterally from the first side of the first portion of the L-shaped fingers;

wherein a tile can be placed on at least one of the tabs and maintained in position by the second portion of at least one of the L-shaped fingers;

wherein the second portion is longer than the first portion in a horizontal direction parallel to the face;

wherein the second portion has a width in a horizontal direction parallel to the face;

wherein the first portion has a length in a horizontal direction perpendicular to the face; and wherein the width of the second portion is longer than the length of the first portion.

14. A support panel comprising:

a plate including a face, at least one row of planar support tabs and at least one row of L-shaped fingers, the planar support tabs being only planar;

the at least one row of L-shaped fingers being located above at least one of the at least one row of support tabs; and the L-shaped fingers including a first portion and a second portion defining the L-shape of the L-shaped fingers;

wherein a tile can be placed on at least one of the tabs and maintained in position by the second portion of at least one of the L-shaped fingers; and wherein the second portion is longer than the first portion in a horizontal direction parallel to the face.

15. The support panel of claim 14, wherein:

the first portion of the L-shaped fingers extend outwardly from the face of the plate and have a first side, a second side, a top side, a bottom side and an end opposite the face; and the second portion of the L-shaped fingers extend laterally from the first side of the first portion of the L-shaped fingers.

16. The support panel of claim 14, wherein:

the at least one row of support tabs comprises a first row of support tabs and a second row of support tabs;

the at least one row of L-shaped fingers comprises a first row of L-shaped fingers and a second row of L-shaped fingers;

the first row of L-shaped fingers is located above the first row of support tabs; and the second row of L-shaped fingers is located above the second row of support tabs.

17. The support panel of claim 16, wherein:

the first row of support tabs and the second row of L-shaped fingers are aligned.

18. The support panel of claim 14, wherein:

the plate includes a plurality of openings therethrough for accepting fasteners for connecting the plate to a support surface.

19. The support panel of claim 14, wherein:

the support tabs have a semi-circular periphery.

20. The support panel of claim 14, wherein:

the plate is comprised of metal.

21. The support panel of claim 14, wherein:

the face of the plate comprises an embossment.

22. The support panel of claim 21, wherein:

the embossment comprises a plurality of vertical lines.

23. The support panel of claim 21, wherein:

the embossment comprises a plurality of diamonds.

24. The support panel of claim 21, wherein:

the embossment comprises a wood grain.

25. The support panel of claim 21, wherein:

the embossment comprises stucco.

26. A support panel comprising:

a plate including a face, at least one row of planar support tabs and at least one row of L-shaped fingers, the planar support tabs being only planar;

the at least one row of L-shaped fingers being located above at least one of the at least one row of support tabs; and the L-shaped fingers including a first portion and a second portion defining the L-shape of the L-shaped fingers;

wherein a tile can be placed on at least one of the tabs and maintained in position by the second portion of at least one of the L-shaped fingers;

wherein the second portion is longer than the first portion in a horizontal direction parallel to the face;

wherein the second portion has a width in a horizontal direction parallel to the face;

wherein the first portion has a length in a horizontal direction perpendicular to the face;

wherein the width of the second portion is longer than the length of the first portion.

* * * * *

UNITED STATES PATENT AND TRADEMARK OFFICE

CERTIFICATE OF CORRECTION

PATENT NO. : 7,617,646 B2
APPLICATION NO. : 10/866933
DATED : November 17, 2009
INVENTOR(S) : Ronald B. Losse It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1556 days.

Signed and Sealed this

Nineteenth Day of October, 2010

David J. Kappos

David J. Kappos
*Director of the United States Patent and Trademark Office*